US005112431A

United States Patent [19]

Gerhardt et al.

[11] Patent Number: 5,112,431

[45] Date of Patent: May 12, 1992

[54] PRESS FOR MAKING PRESSED BOARD

[75] Inventors: Klaus Gerhardt, Rheurdt; Hans-Dietrich Sitzler, Nettetal, both of Fed. Rep. of Germany

[73] Assignee: C. Siempelkamp GmbH & Co., Krefeld, Fed. Rep. of Germany

[21] Appl. No.: 511,412

[22] Filed: Apr. 20, 1990

[30] Foreign Application Priority Data

Apr. 28, 1989 [DE] Fed. Rep. of Germany ..... 3914105

[51] Int. Cl.[5] ..... B30B 7/00

[52] U.S. Cl. ..... 156/583.5; 156/555; 100/154; 425/371

[58] Field of Search ..... 100/154, 271; 156/555, 156/583.5; 425/371

[56] References Cited

U.S. PATENT DOCUMENTS

| | | | |
|---|---|---|---|
| 3,881,852 | 5/1975 | Ahrweiler | 425/371 X |
| 4,645,632 | 2/1987 | Büttger et al. | 156/583.5 X |
| 4,647,417 | 3/1987 | Böttger et al. | 425/371 X |
| 4,895,508 | 1/1990 | Held | 156/555 X |

*Primary Examiner*—David A. Simmons
*Assistant Examiner*—James J. Engel, Jr.
*Attorney, Agent, or Firm*—Herbert Dubno; Andrew Wilford

[57] ABSTRACT

A press for making pressed board has a plurality of longitudinally spaced rigid frames supporting a lower press plate extending longitudinally through the frames and having an upwardly directed upper surface and a downwardly directed lower surface. A layer of insulation upwardly directly engages the lower press plate and downwardly directly engages the press frames so that the lower press plate is supported via the insulation layer directly on the frames. An upper press plate extending longitudinally above the lower plate through the frames has a lower surface defining with the lower press plate a longitudinally through going press gap and a plurality of vertically effective hydraulic actuators are carried on the frames above the upper plate. A layer of insulation upwardly directly engages the actuators and downwardly directly engages the upper press plate so that the upper press plate is supported via the respective insulation layer directly on the actuators. Respective upper and lower endless belts spanned over respective rollers and having respective lower and upper stretches extend through the gap immediately below and above the respective upper and lower plates and respective upper and lower rollers are engaged between the upper and lower plates and the lower and upper belt stretches. The upper and lower plates are heated at the respective lower and upper surfaces and the lower plate is also heated at the respective lower surface.

8 Claims, 5 Drawing Sheets

PRESS FOR MAKING PRESSED BOARD

FIELD OF THE INVENTION

The present invention relates to a press. More particularly this invention concerns such a press used in the manufacture of fiberboard, chipboard, plywood, and the like.

BACKGROUND OF THE INVENTION

A standard press of the type used in the continuous production of fiberboard, particleboard, and the like has a rigid press frame having vertically spaced upper and lower parts defining a press gap that can extend some 30 m. Upper and lower belts are spanned in the respective press parts between respective upstream and downstream rollers, at least one of which is driven to advance confronting upper and lower stretches of the lower and upper belts longitudinally through the press. Upper and lower press plates bear, typically by some sort of roller arrangement, on the lower and upper surfaces of the upper and lower stretches of the lower and upper belts. The lower press plate is fixed The upper plate is vertically movable by means of a double-acting hydraulic actuator system.

The press plates can each be formed of one or more pieces. The rollers can be rods as described in U.S. Pat. No. 4,613,293 or cylindrical rollers formed together to a chain as described in U.S. Pat. No. 3,881,852. The pressure characteristic of the press, that is the amount of force exerted at different regions along the length of the press, is determined by the hydraulic actuators and itself determines the characteristics of the finished board. Coupled with the pressure characteristic is the temperature characteristic, as the temperature distribution of the platens can also vary. Both of these characteristics depend also from the throughput speed of the mat or laminate workpiece being pressed. All of these factors must be controlled to produce a high-quality product.

U.S. Pat. No. 4,645,632 describes a system wherein the lower press plate is supported via insulation on a rigid press table. The upper press plate is carried on at least one longitudinally extending beam which in turn is connected via the hydraulic actuators to the press frames. In order to set the press characteristic it is necessary to elastically deform the upper press plate and the beams, a ]ob that takes a considerable amount of force. At best it is impossible to deform the upstream ends of the platens sufficiently, that is to a small enough radius, to form the desired flared inlet mouth for the press.

OBJECTS OF THE INVENTION

It is therefore an object of the present invention to provide an improved press for making pressed board.

Another object is the provision of such an improved press for making pressed board which overcomes the above-given disadvantages, that is which allows the press characteristic to be adjusted relatively finely, and which allows a relatively wide input mouth to be formed at the upstream end of the press gap.

SUMMARY OF THE INVENTION

A press for making pressed board according to the invention has a plurality of longitudinally spaced rigid frames supporting a lower press plate extending longitudinally through the frames and having an upwardly directed upper surface and a downwardly directed lower surface. A layer of insulation upwardly directly engages the lower press plate and downwardly directly engages the press frames so that the lower press plate is supported via the insulation layer directly on the frames. An upper press plate extending longitudinally above the lower plate through the frames has a lower surface defining with the lower press plate a longitudinally throughgoing press gap and a plurality of vertically effective hydraulic actuators are carried on the frames above the upper plate. A layer of insulation upwardly directly engages the actuators and downwardly directly engages the upper press plate so that the upper press plate is supported via the respective insulation layer directly on the actuators. Respective upper and lower endless belts spanned over respective rollers and having respective lower and upper stretches extend through the gap immediately below and above the respective upper and lower plates and respective upper and lower rollers are engaged between the upper and lower plates and the lower and upper belt stretches. The upper and lower plates are heated at the respective lower and upper surfaces and the lower plate is also heated at the respective lower surface.

Thus the press of this invention does not have or need a lower press table for the lower plate nor an upper beam for the upper plate. This greatly simplifies the construction of the press and makes it possible to deform the plates more sensitively. In view of the lack of backing for the plates, they are somewhat thicker than in prior-art presses, typically having a thickness of between about 100 mm and 150 mm. Heating the outer surfaces of the plates prevents unwanted thermal deformation of these otherwise unreinforced elements.

According to another feature of the invention all the actuators have the same relatively short vertical stroke and the actuators include a plurality of vertically adjustable wedge units downwardly engaging the upper insulation layer. Each wedge unit includes a pair of transversely extending wedges one of which is transversely displaceable relative to the other. Furthermore the wedge units are self-blocking and also the wedges are removable and replaceable. Replaceable spacers are braced vertically between the actuators and the upper plate. This makes it possible to adjust the press characteristic quite finely.

In order to be able to heat the platens, the lower plate is formed adjacent its upper and lower surfaces with respective upper and lower networks of passages and the heater is connected to the passages and supplies a hot liquid thereto. The passages can also be used for cooling the platens.

Furthermore according to the invention the upper press plate has an upwardly curved upstream end and the press has springs braced between the upstream end and the frame. Furthermore at least one of the frames is formed as a double sheet-steel frame against which the respective actuators are braced.

DESCRIPTION OF THE DRAWING

The above and other objects, features, and advantages will become more readily apparent from the following, reference being made to the accompanying drawing in which.

SPECIFIC DESCRIPTION

Figure 1:
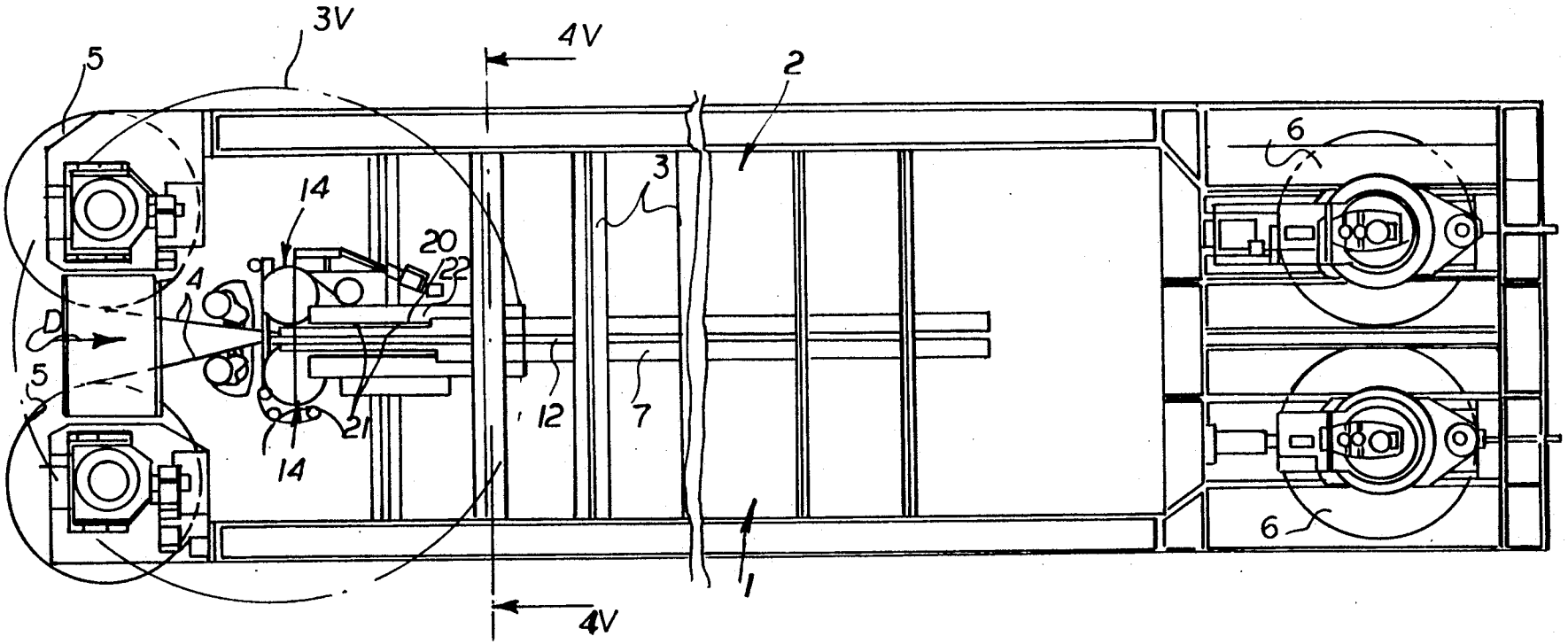
FIG. 1 is a partly diagrammatic side view of the press according to this invention.
Figure 2:
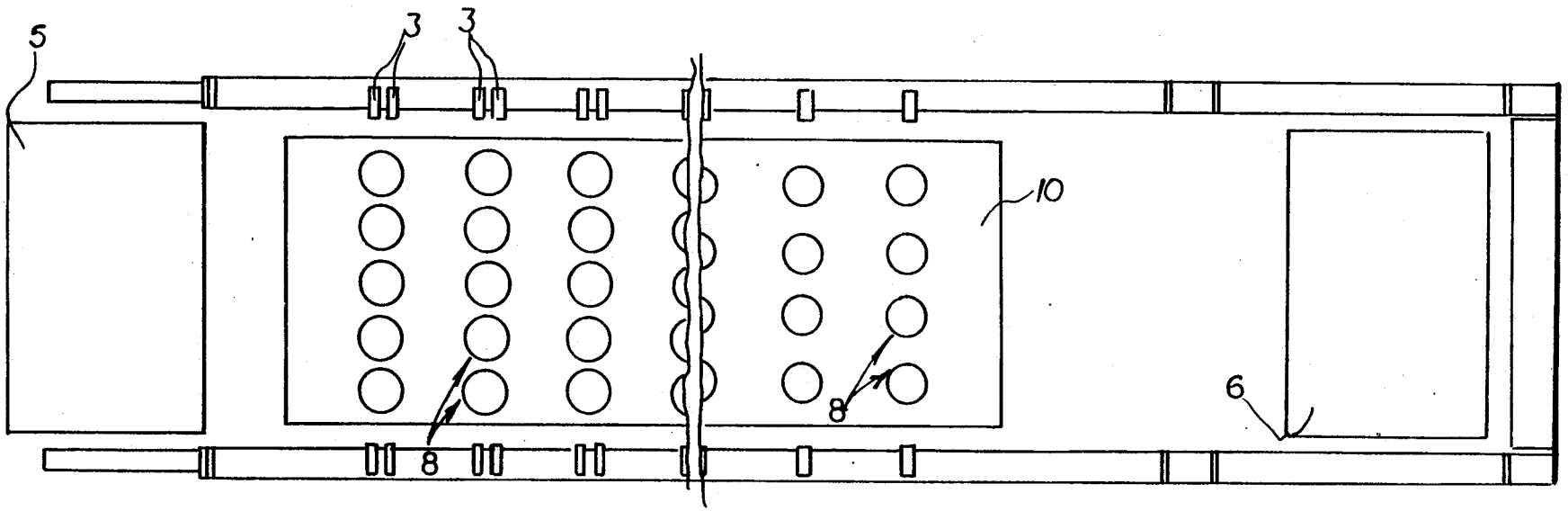
FIG. 2 is a top view of the press.

As seen in the drawing a press according to this invention has a lower part 1 and an upper part 2 supported on upright but longitudinally spaced rigid frames 3 made of double steel beams. Upper and lower endless steel belts 4 are spanned between upstream and downstream rollers 5 and 6, at least one of which is driven, to form a press gap 12 that extends in a longitudinal transport direction D.

A lower press plate or platen 7 lies underneath the upper stretch of the lower belt 4 and is supported via a layer of rigid thermal insulation 15 directly on the frames 3. Rollers 11 connected together to a chain 13 are engaged between the upper surface of the plate 7 and the under surface of the upper stretch of the lower belt 4.

Figure 5:
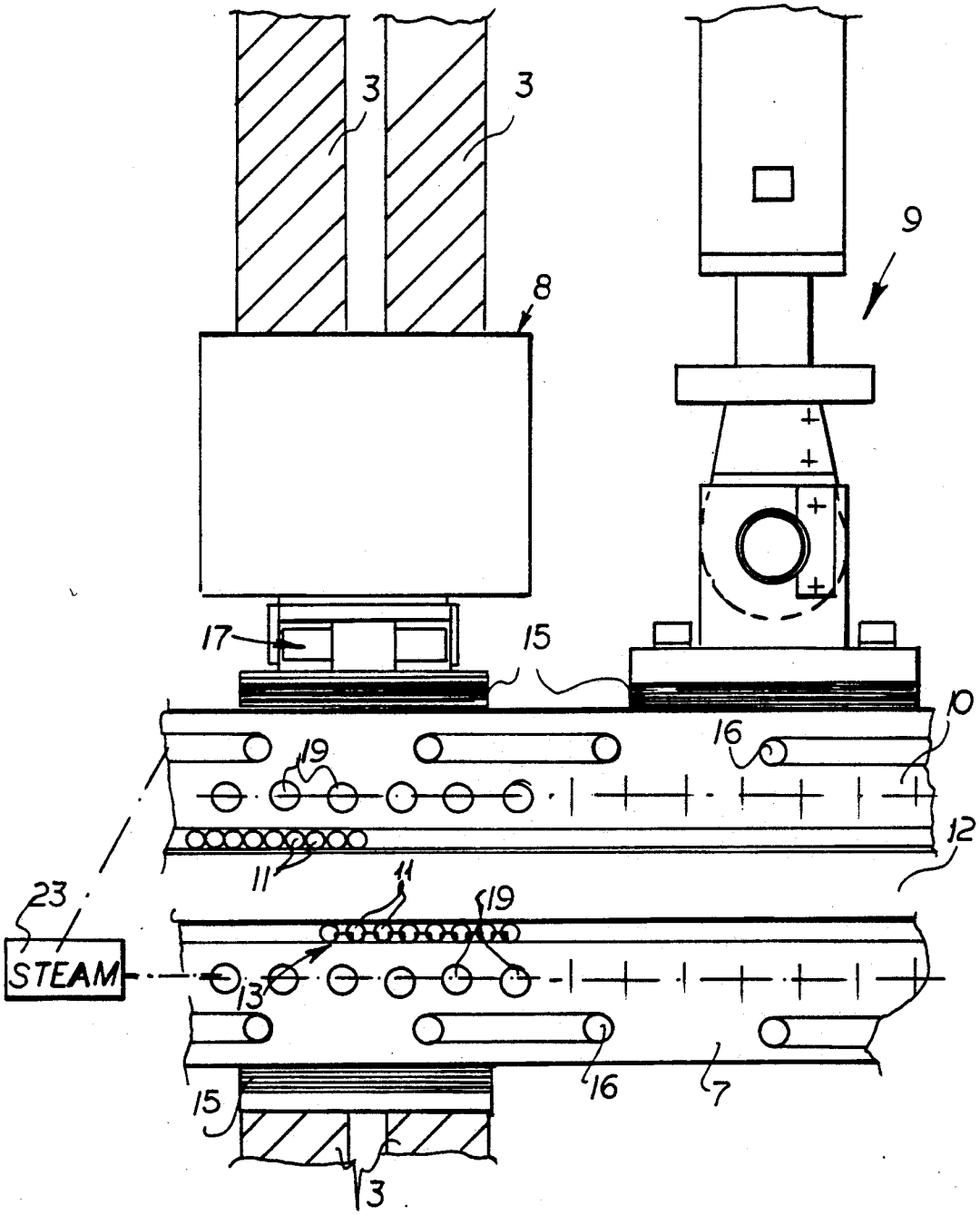
FIG. 5 is a large-scale longitudinal section through a detail of the press.

An upper press plate or platen 10 has a lower surface engaging the upper surface of a lower stretch of the upper belt 4 via rollers 11, like the lower plate 7. This plate 10 has an upper surface provided with insulation pads 15 by means of which it is connected to downwardly expansible hydraulic actuators 8 and upwardly contractile cylinders 9 (FIG. 5) respectively serving to push the plate 10 down and to retract it upward. The horizontal spacing of the actuators determines the pressure distribution in the press and the platens 7 and 10 are each about 90 mm thick and 30 m long. Special infeed devices 14 are provided at the upstream end of the gap 12.

In order to heat a workpiece in the press gap 12 the upper platen 10 is provided immediately above its lower surface and the lower platen 7 immediately below its upper surface with a network of relatively closely spaced passages 19 connected to a supply 23 of steam or hot oil. In addition to avoid thermal deformation of the plates 7 and 10, they are formed adjacent their outer surfaces with networks of somewhat more widely spaced passages 16 also supplied with steam or hot oil from the source 23.

Figure 4:
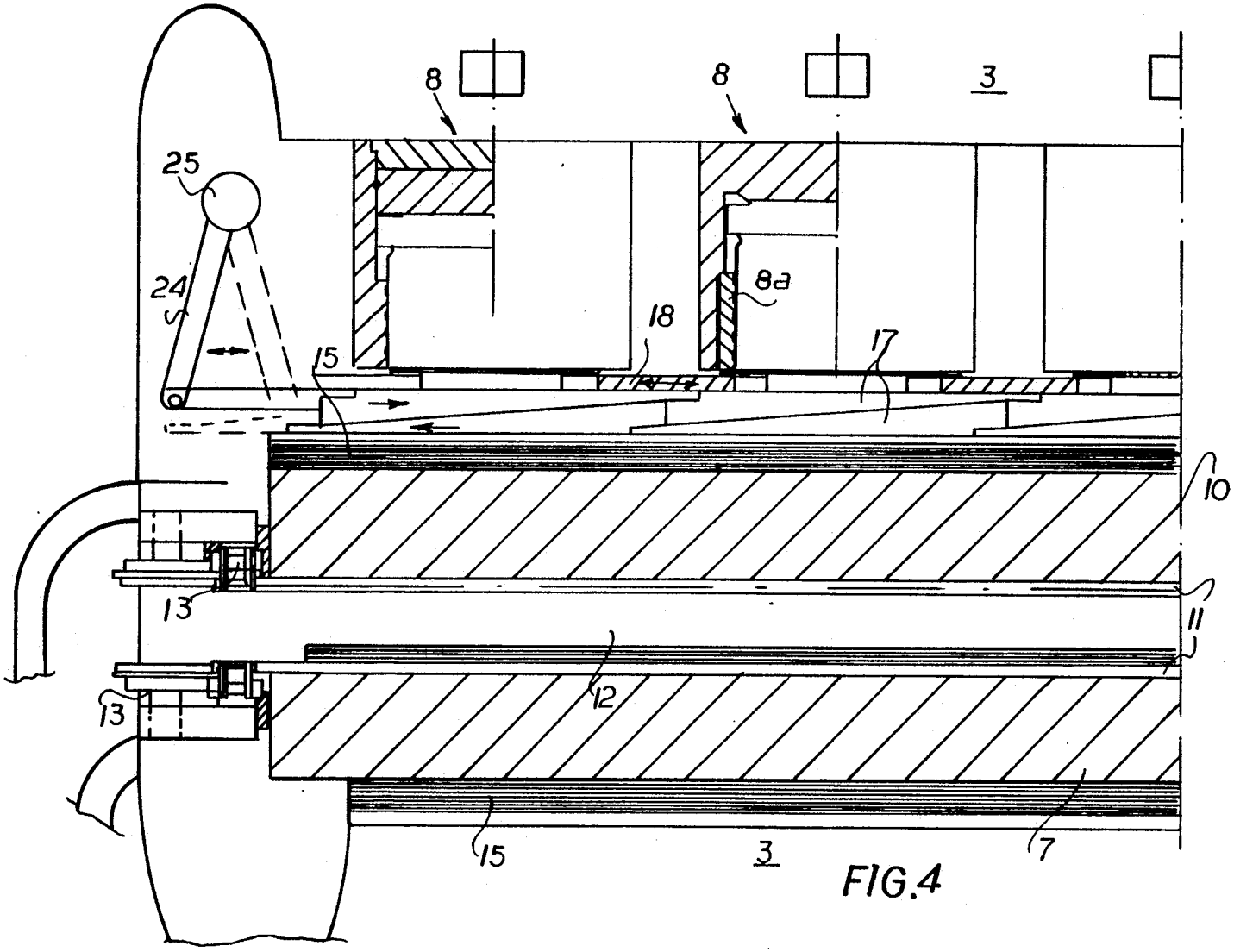
FIG. 4 is a cross section taken along line 4V--4V of FIG. 1.

FIG. 4 shows in some detail how all of the actuators 8 have the same vertical stroke which corresponds to the play of the press. Between the upper plate 10 and the actuators 8 are wedge units 17 which extend and slide transversely of the direction D and which are set up to be self-blocking, that is the vertical pressing forces are not sufficient to cause them to slip horizontally. The upper wedges 17 can be shifted relative to the lower ones by respective arms 24 mounted on a longitudinally extending shaft 25.

Shim sleeves **8*a* are provided in the actuators 8 to prevent them from extending vertically too far. In addition replaceable spacers 18 are provided that allow the height of the press gap 12 to be adjusted without changing the actuators 8**.

Figure 3:
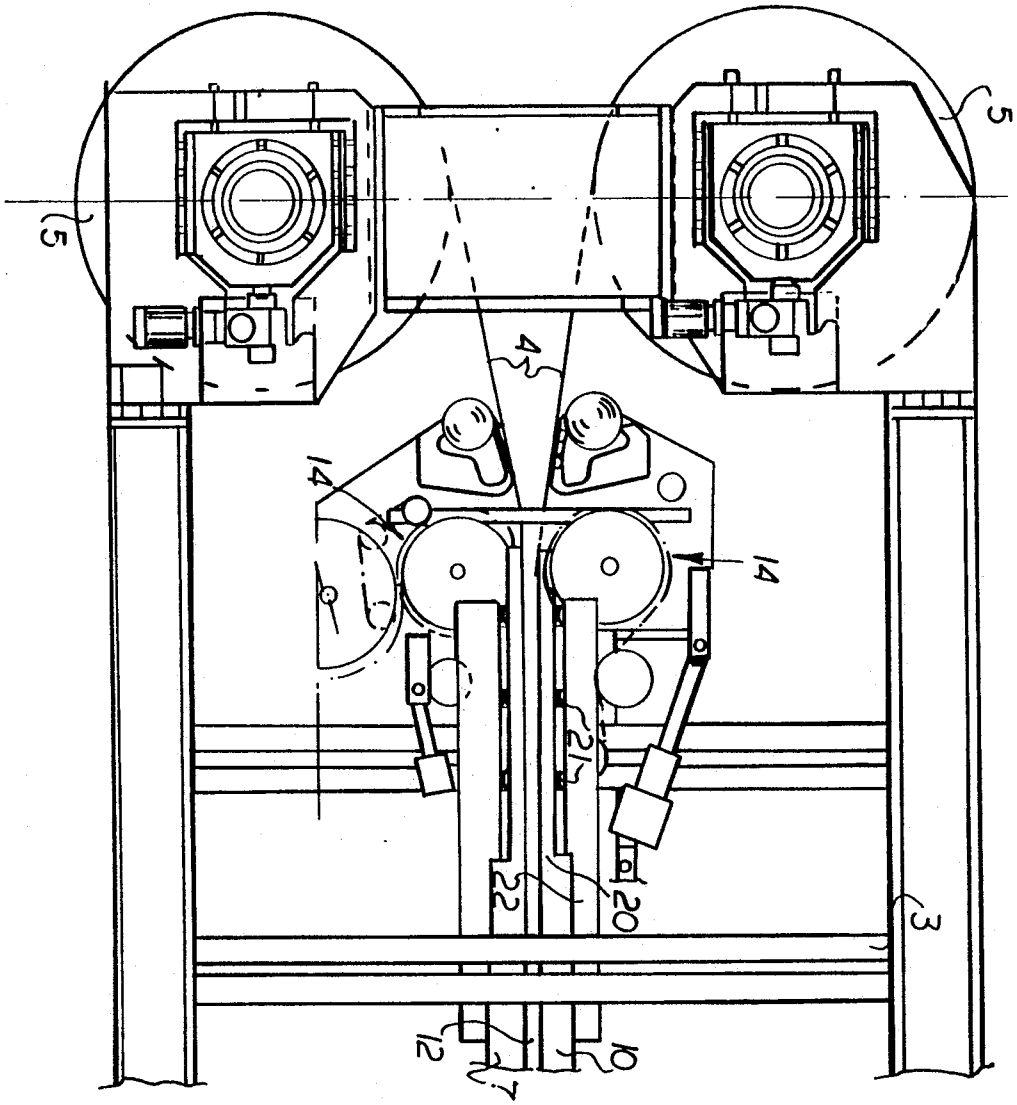
FIG. 3 is a large-scale vie of the detail indicated in circle 3V of FIG. 1.

FIG. 3 shows how the plates 7 and 10 have relatively thin extensions or tongues 20 projecting upstream and supported by hydraulic springs 21 on plates 22 fixed to the full-width plates 7 and 10 and extending over the first one or two frames 3 of the press. The plates 7 and 10 can each be formed as a single unitary element, or as a plurality of overlapping pieces meeting at planes inclined to the direction D. Such use of multi-part press plates allows the occasionally damaged part to be replaced without having to replace the entire plate.

We claim:

1. A press for making pressed board, the press comprising:

a plurality of longitudinally spaced rigid frames;

a lower press plate extending longitudinally through the frames and having an upwardly directed upper surface and a downwardly directed lower surface;

a layer of insulation upwardly directly engaging the lower press plate and downwardly directly engaging the press frames, the lower press plate being supported via the insulation layer directly on the frames;

an upper press plate extending longitudinally above the lower plate through the frames and having a lower surface defining with the lower press plate a longitudinally throughgoing press gap;

a plurality of vertically effective hydraulic actuators carried on the frames above the upper plate, each actuator including a pair of transversely extending wedges one of which is transversely displaceable relative to the other;

means for pressurizing the actuators and thereby vertically expanding same through the same relatively short vertical stroke, the wedge pairs being individually adjustable to adjust the shape of the upper press plate along its length;

a layer of insulation upwardly directly engaging the wedges and downwardly directly engaging the upper press plate, the upper press plate being supported via the respective insulation layer directly on the wedges;

respective upper and lower endless belts having respective lower and upper stretches extending through the gap immediately below and above the respective upper and lower plates;

respective upper and lower rollers engaged between the upper and lower plates and the lower and upper belt stretches; and means for heating the upper and lower plates at the respective lower and upper surfaces and also for heating the lower plate at the respective lower surface.

2. The press defined in claim 1 wherein the plates have a thickness of between 100 mm and 150 mm.

3. The press defined in claim 1 wherein the wedge units are self-blocking.

4. The press defined in claim 1 wherein the wedges are removable and replaceable.

5. The press defined in claim 1 wherein the actuators further comprise spacers braced vertically between the actuators and the upper plate.

6. The press defined in claim 1 wherein the lower plate is formed adjacent its upper and lower surfaces with respective upper and lower networks of passages, the heating means being connected to the passages and supplying a hot fluid thereto.

7. The press defined in claim 1 wherein the upper press plate has an upwardly curved upstream end, the press further comprising springs braced between the upstream end and the frame.

8. The press defined in claim 1 wherein at least one of the frames is formed as a double sheet-steel frame, the respective actuators being braced thereon.

* * * * *